US006109881A

United States Patent [19]

Snodgrass et al.

[11] Patent Number: 6,109,881

[45] Date of Patent: Aug. 29, 2000

[54] GAS DRIVEN PUMP FOR THE DISPENSING AND FILTERING OF PROCESS FLUID

[76] Inventors: Ocie T. Snodgrass, 2017 Overview, Garland, Tex. 75044; Gregory M. Gibson, 6343 Goliad, Dallas, Tex. 75214

[21] Appl. No.: 09/005,172

[22] Filed: Jan. 9, 1998

[51] Int. Cl.[7] ..... F04B 19/24

[52] U.S. Cl. ..... 417/53; 417/387

[58] Field of Search ..... 417/384, 385, 417/387, 118, 120, 126, 137, 138, 143, 144

[56] References Cited

U.S. PATENT DOCUMENTS

| | | | |
|---|---|---|---|
| 4,436,491 | 3/1984 | Ishiyama et al. | 417/385 |
| 5,056,036 | 10/1991 | Van Bork | 364/510 |
| 5,165,869 | 11/1992 | Reynolds | 417/385 |
| 5,167,837 | 12/1992 | Snodgrass et al. | 210/767 |
| 5,516,429 | 5/1996 | Snodgrass et al. | 210/767 |
| 5,772,899 | 6/1998 | Snodgrass et al. | 210/767 |

*Primary Examiner*—Timothy S. Thorpe
*Assistant Examiner*—David J. Torrente
*Attorney, Agent, or Firm*—John Dana Hubbard, Esq.; Timothy J. King, Esq.

[57] ABSTRACT

A gas driven pump controls the process fluid pressure within a filtering and dispensing system. A pressure controller in the pump controls gas pressure within an enclosed chamber in the pump. The gas chamber is adjacent a floating piston that rests atop a layer of incompressible fluid in a fluid chamber. The incompressible fluid connects to a diaphragm head. As the gas pressure is increased, the floating piston will transmit that pressure through the incompressible fluid that then forces a relative displacement in the process fluid flow. A feedback system used in conjunction with the gas driven pump controls the gas pressure in order to regulate the process fluid flow.

In addition, a positive displacement compensator can be used in conjunction with the gas driven pump in order to further regulate the process flow.

4 Claims, 4 Drawing Sheets

GAS DRIVEN PUMP FOR THE DISPENSING AND FILTERING OF PROCESS FLUID

TECHNICAL FIELD

The present invention relates to pumps for dispensing fluids that are or may be expensive, viscous, high purity, and/or sensitive to molecular shear.

BACKGROUND OF THE INVENTION

The process control of fluids in a pumping system has numerous applications, but it is especially useful in the microelectronics industry. However, the slightest contamination within the fluids used in producing microelectronic devices can create defects, decrease production yields, degrade device performance, and reduce device reliability. As a corollary, the pumps that distribute fluid onto the substrates that form such devices have to be able to deliver precise and accurate amounts of fluid. Moreover, the manner in which the fluid is delivered in layers by the pump is critical for producing such devices.

The trend in the microelectronics industry is to squeeze greater quantities of circuitry onto smaller substrates. Circuit geometries have been shrunk to less than one micron. In that microscopic world, the slightest particle of contamination or variations in thickness in the layering of fluid delivered to the substrate can create a defect, decreasing production yields, degrading device performance, and reducing device reliability.

For this and other reasons, modern manufacturing techniques in the microelectronics and other industries sometimes involve decontaminated "cleanroom" environments. Many of these techniques also use so-called advanced process chemicals, some of which are very expensive. For example, certain chemicals used to process semiconductors can cost as much as $15,000 or more per gallon, and the semiconductor substrates can be worth $20,000 or more at that stage or processing.

To be useful in cleanroom environments and applications, however, the chemicals must be filtered and dispensed. Because of the viscosities and sensitivities of the fluids, they must be filtered at low flow rates and under low pressure to minimize molecular shear on the fluids. After the filtration of the process fluids, the process fluid is typically dispensed onto a substrate. Depending on the usage of the substrate, dispensing ability of a pump can be allowed to vary. There is typically a cost efficiency analysis that can be applied to such pumps. For example, certain prior art systems utilize diaphragm-type pumps in which the diaphragm is actuated by air pressure. Typically, the actuating air is more compressible than the liquids being pumped. As air pressure is increased in an attempt to displace the diaphragm and dispense fluid, the actuating air is compressed, in effect "absorbing" part of the intended displacement of the diaphragm. This air compression prevents accurate control and monitoring of the position of the diaphragm and, correspondingly, it prevents accurate control and monitoring of the volume and rate of fluid dispensed.

However, it is clear that an air driven pump that would overcome this problem provides significant advantages. Such pumps are simpler to maintain and less costly than a digitally controlled electro-hydraulic pump, and they are also at least, if not more accurate than a simple pneumatic pump. There is therefore a need in the art to develop an air-driven pump that has greater levels of accuracy and can provide an "intermediate" level of dispense performance.

SUMMARY OF THE INVENTION

A primary object of the invention is to provide an air pump having a diaphragm that is accurately controlled and positioned.

Another primary object is to provide such a pump powered by a low cost motive force combined with a suitable feedback control system, to provide accurate dispense performance.

Another object of the invention is to provide a gas driven pump with a floating piston preferably equipped with a sensor to provide fluid displacement feedback information that is then useful in controlling the process flow.

Yet another object of the invention is to provide a displacement compensator to further regulate the process flow.

Still another object of this invention is to provide a fluid dispensing system which can be utilized in filtering viscous and other fluids under relatively low pressure, thereby decreasing molecular shear on the fluids. A preferred embodiment of the invention allows the fluid to be filtered continuously (and thus at a relatively low pressure and flow rate) with an air driven pump, while being fine tuned by another positive displacement diaphragm.

A further object of the invention is to place the gas driven pump regulated by a positive displacement diaphragm into a dual stage pump system to improve dispense performance.

The foregoing has outlined some of the more pertinent objects and advantages of the present invention. These objects should be construed to be merely illustrative of some of the more prominent features and applications of the invention. Many other beneficial results can be attained by applying the disclosed invention in a different manner or by modifying the invention. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

DETAILED DESCRIPTION

The present invention describes a gas driven pump for use in a dispensing system wherein the precision of the pump is preferably maintained by a positive displacement compensator.

Figure 1:
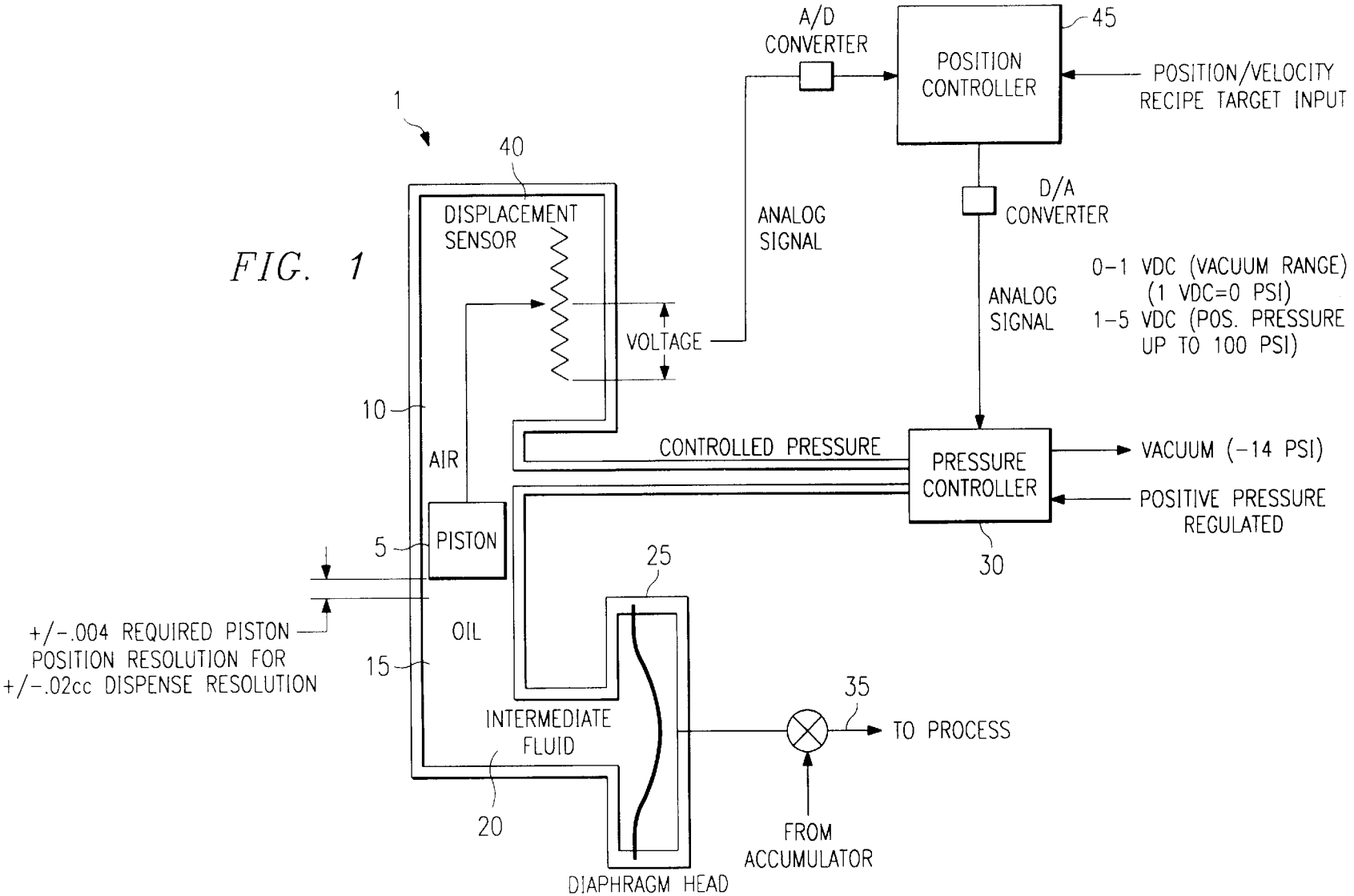
FIG. 1 is a system control diagram of an air driven pump.

The gas driven pump in its preferred embodiment uses pressurized air, although this is not a requirement. Other pressurized gases such as nitrogen, oxygen and the like are also contemplated. As seen in FIG. 1, the pump 1 preferably comprises two "chambers" divided by a piston 5 that "floats" or reciprocates between the chambers. One chamber 10 is filled with air (or other gas medium), while the floating piston 5 rests on the second chamber 15 that is filled with a fluid or preferably an incompressible fluid 20. As used herein, "incompressible fluid" describes a liquid that will retain the same volume under additional pressure. The fluid is in contact with the diaphragm head 25. The diaphragm 25 ideally forms a flexible wall between the incompressible fluid and the process fluid. In this manner, the diaphragm pump controls the process fluid flow. The pump 1, when used in a dual stage filtering and dispensing system, can therefore be used to either dispense the process fluid or control the process fluid flow in the dispensing and filtering system. Such use, however, is merely exemplary.

A pressure controller 30 is used to regulate the air pressure within the air chamber 10. As the air pressure is increased in the air chamber, the resulting pressure forces the piston away from the chamber. With a greater pressure differential on the side of the air chamber, the floating piston 5 applies pressure to the intermediate fluid. Since the fluid is incompressible and retains the same volume, it in turn displaces the diaphragm 25, thereby pumping the process fluid 35 in the system.

Because the air driven pump is preferably used in sensitive operations, such as dispensement of the subject fluid or controlling the flowrate to a filter, it is desirable that the proper feedback and measurement controls are incorporated into the pump. To this end, a displacement sensor 40 is located within the air chamber 10 for determining the relative displacement of the piston at a given air pressure. The sensed information is sent to a position controller 45 that is linked to the pressure controller 30 so that both controllers are synchronized regarding the relation of the given air pressure in the pump to the floating piston displacement. The displacement sensor for the feedback control system can use either an optical or a laser sensor to determine the displacement of the piston.

Figure 2:
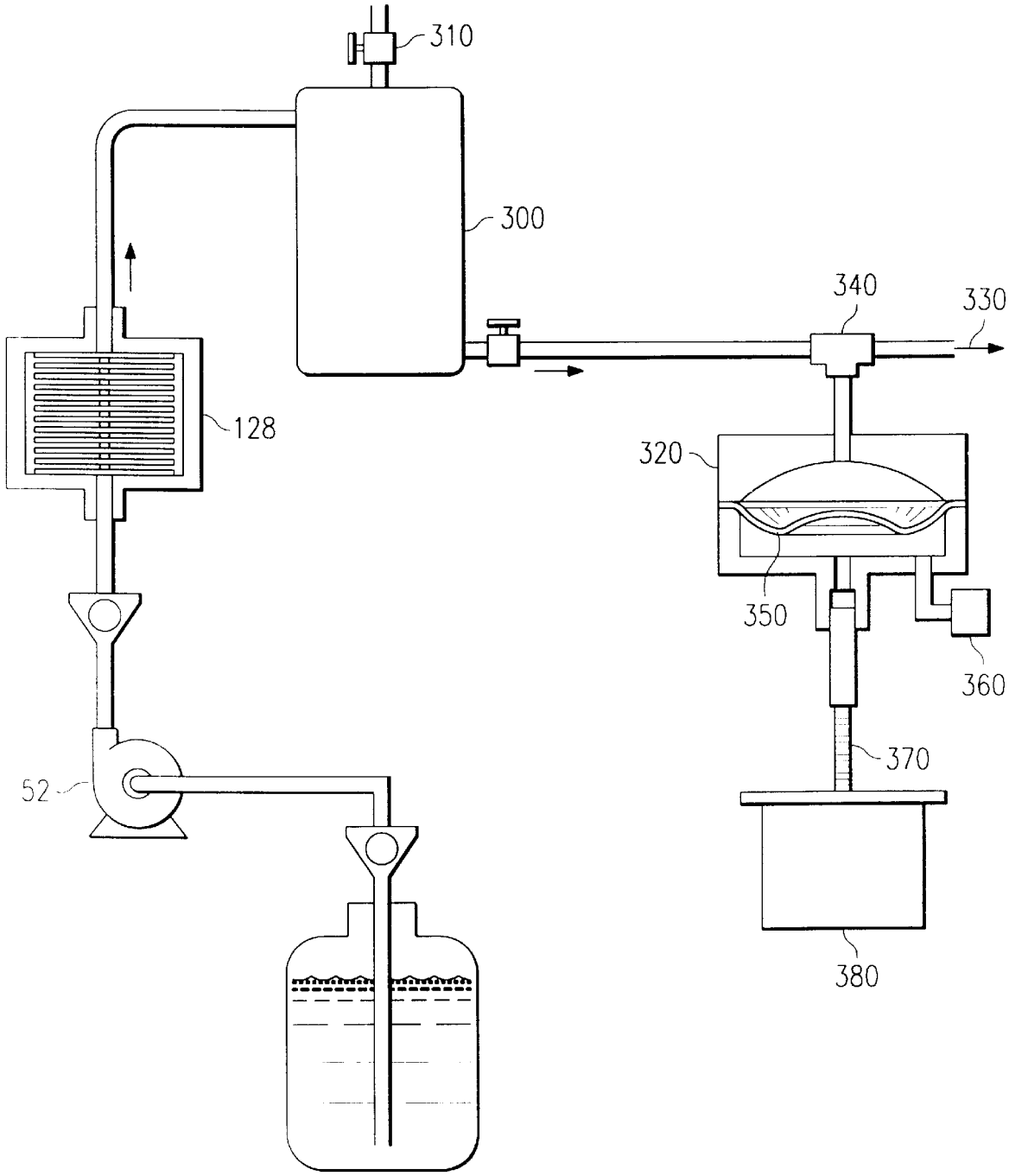
FIG. 2 is a system diagram for an air driven pump system with a positive displacement compensator.

Referring to FIG. 2, which is a system diagram of an air driven pump with a displacement compensator, when the air driven pump 52 pumps off the vented bottle, the liquid will be processed through the filter element 128. Pump 52 will use negative pressure to draw fluid from the bottle. The pump is regulated indirectly by regulating the air that drives the diaphragm (not shown). The fluid is pumped over the filter element by the positive pressure generated by the pump 52. There is some pressure drop over the filter head. In a preferred embodiment, there is a reservoir 300 that contains a vent valve 310. This reservoir is controlled by the positive displacement compensator 320 in regard to the process flow 330.

The compensator functions by applying a pressure change to the fluid 330 exiting the reservoir. There is preferably a three way valve 340 at the junction of the process flow and the displacement compensator. The positive displacement compensator 320 has a diaphragm 350 and a pressure transducer 360. In one embodiment, there is a piston 370 powered by a stepper motor 380 that compresses the fluid in the compensator to flex the diaphragm.

Figure 3:
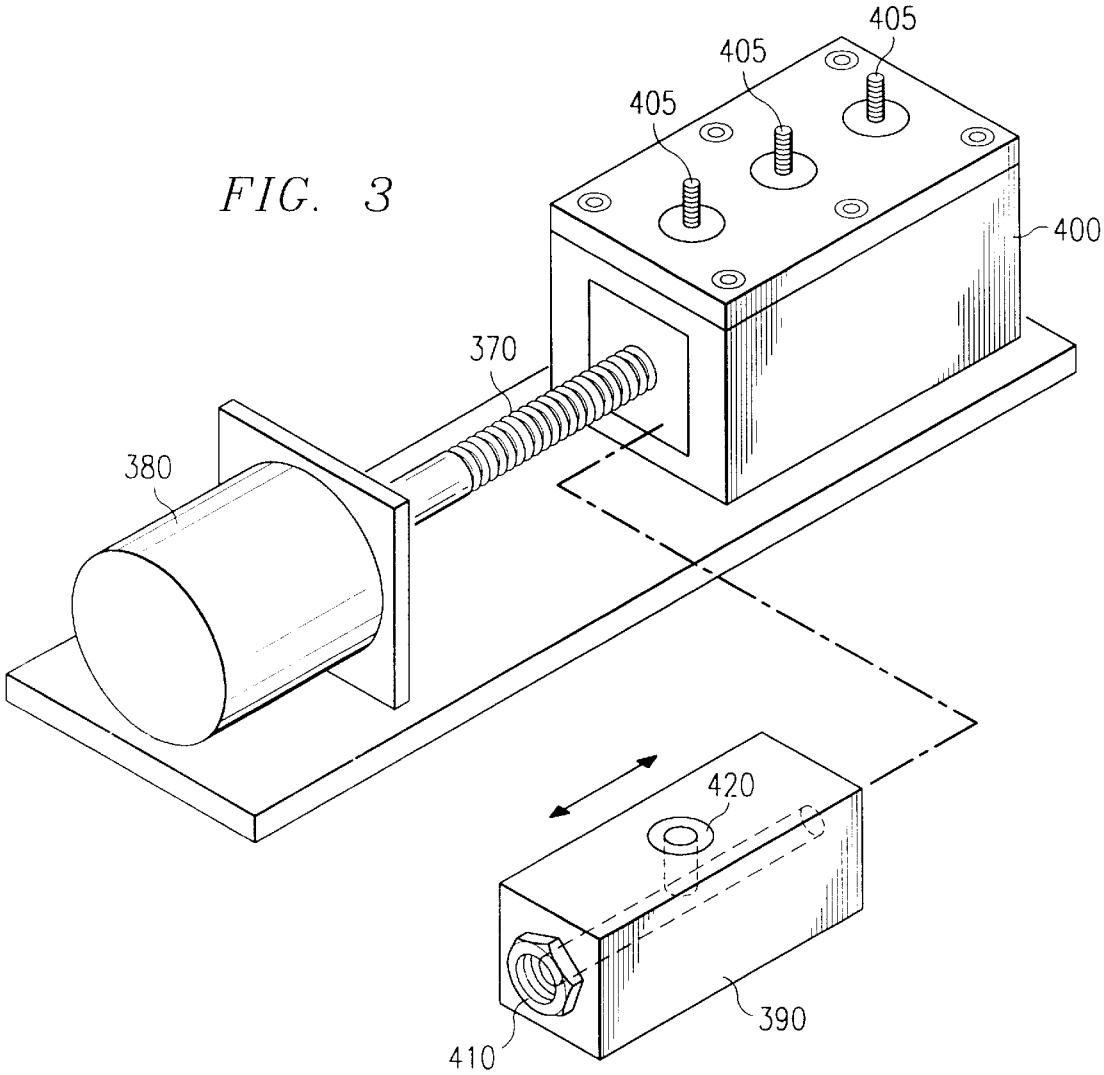
FIG. 3 is a perspective view of the positive displacement compensator.

FIG. 3 shows the diaphragm compensator embodiment with the stepper motor and piston. The stepper motor 380 is connected to a screw 370 which pushes the moving block 390 which is located within block housing 400. The moving block has a linear actuator nut 410 to fit in with the screw 370 and has holes in the surface to allow for proportional control 420. The block housing 400 also encases the positive displacement diaphragm (not shown). There are a number of vents 405 in the housing 400 to regulate the pressure.

Another embodiment of the displacement compensator incorporates a floating puck mechanism which includes the location of a sensor on top of the compression fluid in the displacement compensator provides the necessary data for feedback control. The sensor provides feedback control data regarding the action of the diaphragm and the regulation of the process.

Figure 4:
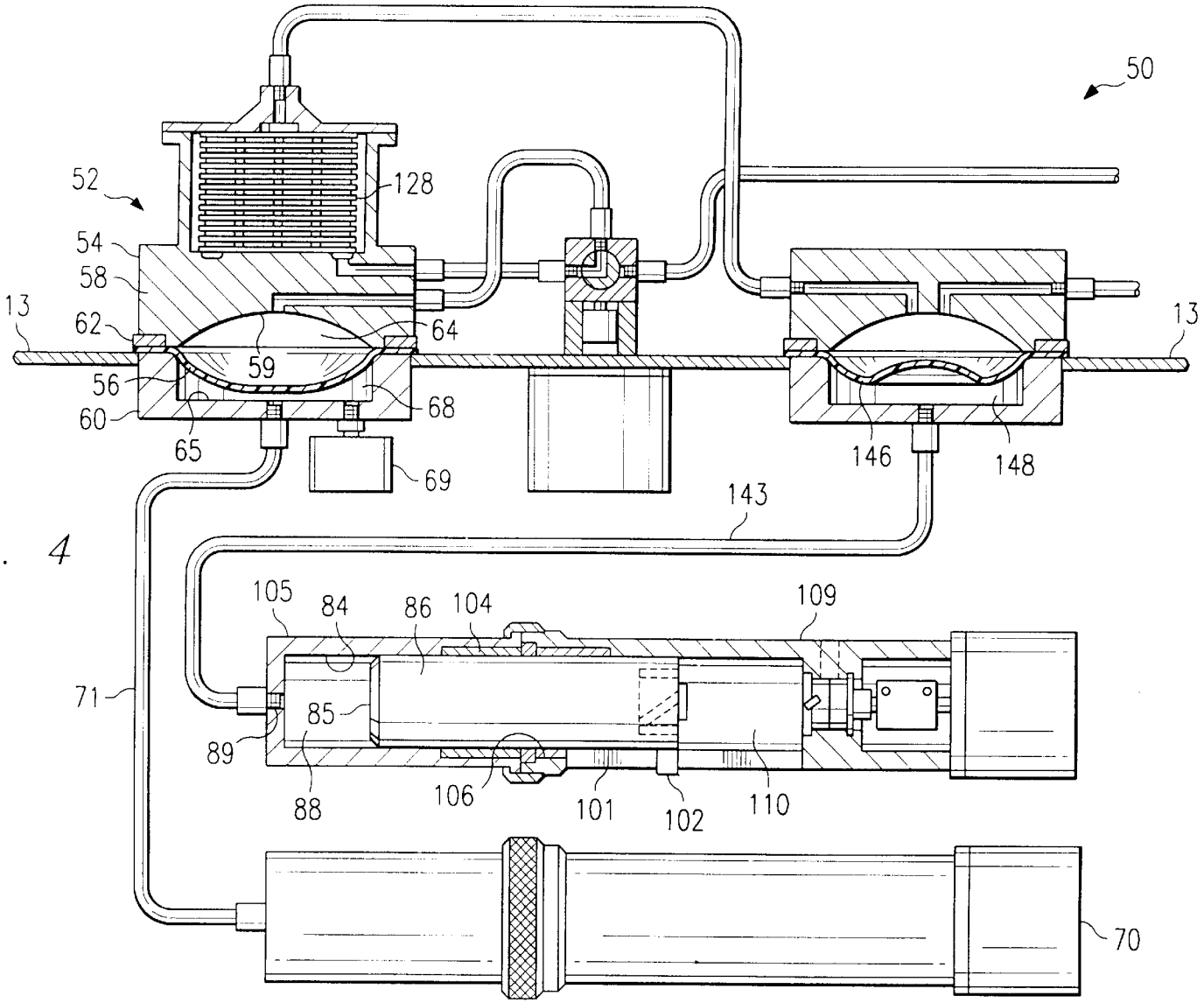
FIG. 4 is a block diagram illustrating the incorporation of the pump in a pump filtering and dispensing system.

Referring to the system in FIG. 4, this figure illustrates an embodiment of the inventive air pump technique within a dual stage pump system. In this illustrated application, the air driven pump can comprise one or both of the pump "stages" within the system. The first pump stage 50 includes a first pumping member 52, constituting master diaphragm pump 54 mounted on plate 13, first incremental pump means 70, and tubing 71 therebetween. Pump 54 includes upper housing 58 machined from stainless steel, lower housing 60 machined from aluminum, and TEFLON® (polytetrafluoroethylene) diaphragm 56 disposed therebetween. Diaphragm 56 is retained in sealing engagement between upper and lower housings 58 and 60 at least in part by sealing ring 62, which is disposed between housings 58 and 60 at their mutual peripheries.

Housings 58 and 60 are so machined that, when assembled with diaphragm 56 and sealing ring 62, a pumping chamber 65 is formed between said housings, said chamber being divided by diaphragm 56 into an upper compartment 64 and a lower compartment 68. Upper compartment 64 is defined by diaphragm 56 and internal surface 59 of upper housing 58. Internal surface 59 is shaped so that diaphragm 56 can, when sufficiently deflected, conform thereto. When so deflected, the capacity of compartment 64 is nil, all fluid having been purged therefrom.

Piston anti-rotation bearing 102 is fixedly connected to piston 86 and slidably disposed in slot 101, to prevent rotation of piston 86 in cylinder 84. As piston 86 reciprocates in cylinder 84, bearing 102 correspondingly reciprocates in slot 101, which is axially oriented in one side of housing component 109. Air compartment 110 is pressurized to which drive piston 86. Energized TEFLON® (polytetrafluoroethylene) scraper seals 106 and bronze piston guides 104 are located adjacent the juncture of housing components 105 and 109. Seals 106 and guides 104 are retained in annular grooves in the wall of cylinder 84, to prevent fluid leakage from cylinder 84 and to guide piston 86 in cylinder 84.

Piston 86 has an end 85 which, together with cylinder 84, defines chamber 88. To implement the air driven pump, chamber 88 is filled with an incompressible fluid such as oil. Housing component 105 includes port 6 which provides fluid communication between chamber 88 and tubing 143.

Because diaphragm 56 of first pump member 52 is actuated in a similar manner to the actuation of diaphragm 146 in second pump member 142, a discussion of the latter is illustrative of both. As piston 86 is reciprocated in cylinder 84, incompressible fluid is selectively either forced from chamber 88 through tubing 143 to compartment 148, or withdrawn in the opposite direction by relative negative pressure (a partial vacuum) in chamber 88. These alternative fluid conditions, in turn, cause corresponding alternative deflection of diaphragm 146. This displacement of diaphragm 146 is volumetrically equivalent to the displacement of piston 86.

Movement of diaphragm 146 can be accurately controlled because the above-discussed precise movements of piston 86 are transmitted to diaphragm 146 with relatively no distortion through the incompressible fluid medium. As noted above, movements of diaphragm 146 are relatively accurate and repeatable in comparison to prior art dispense pump systems which use, for example, solely compressible fluids such as air to deflect diaphragm 146.

During both the initial priming operation of the system and the subsequent stages of processing in which the compartment 64 is recharged with the subject fluid, the rate of deflection of diaphragm 56 is closely controlled to limit the amount of relative negative pressure created in compartment

64. The pressure is monitored by pressure sensor 69, and the operation of incremental pump means 70 is adjusted accordingly. This close control is necessary to prevent "outgassing" in the subject fluid. If the negative pressure becomes excessive, undesirable gas pockets may form in the subject fluid.

In some prior art systems, the pressure differential across the filter is limited by the pressure available to actuate the diaphragm pump. In the preferred embodiment, however, because relatively incompressible fluid is used in lower compartment 68 and throughout the relevant ports, tubing and incremental pump means 70, there is no corresponding limitation on differential pressure applied across filter element 128. Assuming that the subject fluid is also relatively incompressible, flow rate across filter element 128 is controlled by the movement of a piston similar to piston 86) in incremental pump means 70. In effect, a given volumetric displacement of piston 86 results in an equivalent volumetric displacement of diaphragm 56. Although incoming fluid pressure may increase as filter element 128 becomes blocked through use, the rate and amount of fluid flow are unaffected by such blockage; that is, an incremental rate or amount of movement of piston 86 will result in a corresponding rate and amount of fluid flow through filter element 128.

It should be appreciated by those skilled in the art that the specific embodiments disclosed above may be readily utilized as a basis for modifying or designing other methods for carrying out the same purposes of the present invention. It should also be realized by those skilled in the art that such equivalent constructions do not depart from the spirit and scope of the invention as set forth in the appended claims.

What is claimed is:

1. A pump that utilizes gas and liquid mediums in separate chambers for dispensing process fluids comprising:

a housing;

a piston moveable within a portion of the housing to define first and second pump chambers, wherein the first pump chamber is designed to receive a substantially gas medium and the second pump chamber to receive a substantially fluid medium;

a working element within the second pump chamber, wherein when the second chamber is filled with the fluid medium, the fluid medium displaces the working element;

means for selectively varying pressure of the gas medium in the first chamber, wherein when the first chamber is filled with the gas medium, selective variation of the gas medium pressure providing selective displacement of the piston;

a pressure controller for controlling the gas pressure in the first pump chamber;

a position controller which determines the status of the piston and interacts with the pressure controller to control the position of the piston;

a means for gauging the displacement of the piston due to pressure changes in the first pump chamber;

a means for transmitting the displacement data to the position controller; and a means controlled by the pressure controller for changing the pressure in the first pump chamber.

2. The pump of claim 1, wherein the means for gauging the displacement of the floating pump is a laser.

3. The pump of claim 1 wherein the means for gauging the displacement of the floating pump is a displacement sensor.

4. A method for accurately pumping process fluid, the method comprising the steps of:

disposing a first chamber containing gas and a second chamber containing intermediate fluid within a housing, wherein the gas in said first chamber has a pressure;

disposing a diaphragm in communication with said intermediate fluid within said housing and with said process fluid, wherein said diaphragm is within said second chamber;

disposing a piston in between said first chamber and said second chamber, wherein the piston is movable between said first chamber and said second chamber;

selectively varying the gas pressure in the first chamber, thereby varying the position of the piston, the intermediate fluid, and the diaphragm and enabling accurate pumping of said process fluid;

measuring the gas pressure;

measuring the displacement of the piston;

analyzing the relationship between gas pressure and piston displacement; and adjusting the gas pressure to move the piston.

* * * * *